US007942494B2

(12) United States Patent
Hayashi et al.

(10) Patent No.: US 7,942,494 B2
(45) Date of Patent: May 17, 2011

(54) LIQUID-DISCHARGE-FAILURE DETECTING APPARATUS, AND INKJET INKJET RECORDING APPARATUS

(75) Inventors: Hirotaka Hayashi, Nagoya (JP); Kazumasa Ito, Tajimi (JP)

(73) Assignee: Ricoh Elemex Corporation, Nagoya-shi (JP)

( * ) Notice: Subject to any disclaimer, the term of this patent is extended or adjusted under 35 U.S.C. 154(b) by 193 days.

(21) Appl. No.: 12/277,093

(22) Filed: Nov. 24, 2008

(65) Prior Publication Data

US 2009/0141057 A1 Jun. 4, 2009

(30) Foreign Application Priority Data

Nov. 30, 2007 (JP) ..... 2007-309713

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

2005/0253890 A1 11/2005 Nagashima

FOREIGN PATENT DOCUMENTS

JP 2006-047235 A 2/2006
JP 2007-130778 A 5/2007

OTHER PUBLICATIONS

U.S. Appl. No. 12/265,355, filed Nov. 5, 2008, Ito et al.

*Primary Examiner* — Julian D Huffman
(74) *Attorney, Agent, or Firm* — Foley & Lardner LLP

(57) ABSTRACT

A liquid-discharge-failure detecting apparatus includes a light-emitting element and a light-receiving element. The light-emitting element emits a laser beam in a direction that intersects with a direction in which a droplet of liquid is discharged. The beam is elliptical in cross section. The light-receiving element receives a scattered light generated by scattering of the laser beam by the droplet. The light-receiving element is externally adjacent to a circumference of the beam at a position where a beam diameter of the beam is small.

9 Claims, 9 Drawing Sheets

LIQUID-DISCHARGE-FAILURE DETECTING APPARATUS, AND INKJET INKJET RECORDING APPARATUS

CROSS-REFERENCE TO RELATED APPLICATIONS

The present application claims priority to and incorporates by reference the entire contents of Japanese priority document 2007-309713 filed in Japan on Nov. 30, 2007.

BACKGROUND OF THE INVENTION

1. Field of the Invention

The present invention relates to a technology for detecting a liquid discharge failure in an inkjet recording apparatus.

2. Description of the Related Art

Some types of apparatuses, such as a liquid measurement apparatus disclosed in Japanese Patent Application Laid-open No. 2006-47235, include a laser-beam generating unit, and detect a shadow of the droplet projected by the laser beam. The laser-beam generating unit emits a laser beam in a direction that intersects with a direction in which a droplet of liquid is discharged.

The liquid measurement apparatus disclosed in Japanese Patent Application Laid-open No. 2006-47235 includes a laser-beam generating unit, a photoelectric conversion unit, and a signal processing unit. The laser-beam generating unit generates a laser beam toward a passage of a droplet of liquid. The photoelectric conversion unit converts an optical intensity of the laser beam into an electric signal, which is then processed by the signal processing unit. The signal processing unit stores therein a relational expression between optical intensity expressed in electric signal and weight of droplet of liquid. The liquid measurement apparatus calculates a weight of a droplet by referring to the relational expression for an optical intensity expressed in an electric signal fed from the photoelectric conversion unit. The liquid measurement apparatus further includes a beam converging unit that converges a laser beam. A droplet of liquid is discharged through a liquid discharging head toward the converged beam. Accordingly, spatial resolution is increased, resulting in an increase in signal strength.

However, in such a liquid measurement apparatus, when liquid is to be discharged from two or more positions, it is necessary to change the position to which the laser beam converges by, for example, moving the beam converging unit. Accordingly, this type of liquid measurement apparatus is disadvantageous because it requires a drive mechanism to move the beam converging unit. Provision of the drive mechanism increases the costs makes the overall configuration complex.

SUMMARY OF THE INVENTION

It is an object of the present invention to at least partially solve the problems in the conventional technology.

According to an aspect of the present invention, there is provided a liquid-discharge-failure detecting apparatus that detects a liquid discharge failure of a droplet of discharged liquid. The liquid-discharge-failure detecting apparatus includes a light-emitting element that emits a light beam onto the droplet, wherein the light-emitting element emits the light beam in a direction intersecting a discharge direction in which the droplet is discharged; a light-receiving element that receives a scattered light generated by scattering of the light beam by the droplet when the light beam strikes the droplet; and a failure detecting unit that detects the liquid discharge failure by using data pertaining to the scattered light received by the light-receiving element, wherein the light beam is elliptical in cross section, and the light-receiving element is externally adjacent to a circumference of the light beam at a position at which a beam diameter of the beam is small.

According to another aspect of the present invention, there is provided an inkjet recording apparatus that includes the above liquid-discharge-failure detecting apparatus and a stand-alone recovery unit that recovers a liquid discharge failure detected by the liquid-discharge-failure detecting apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
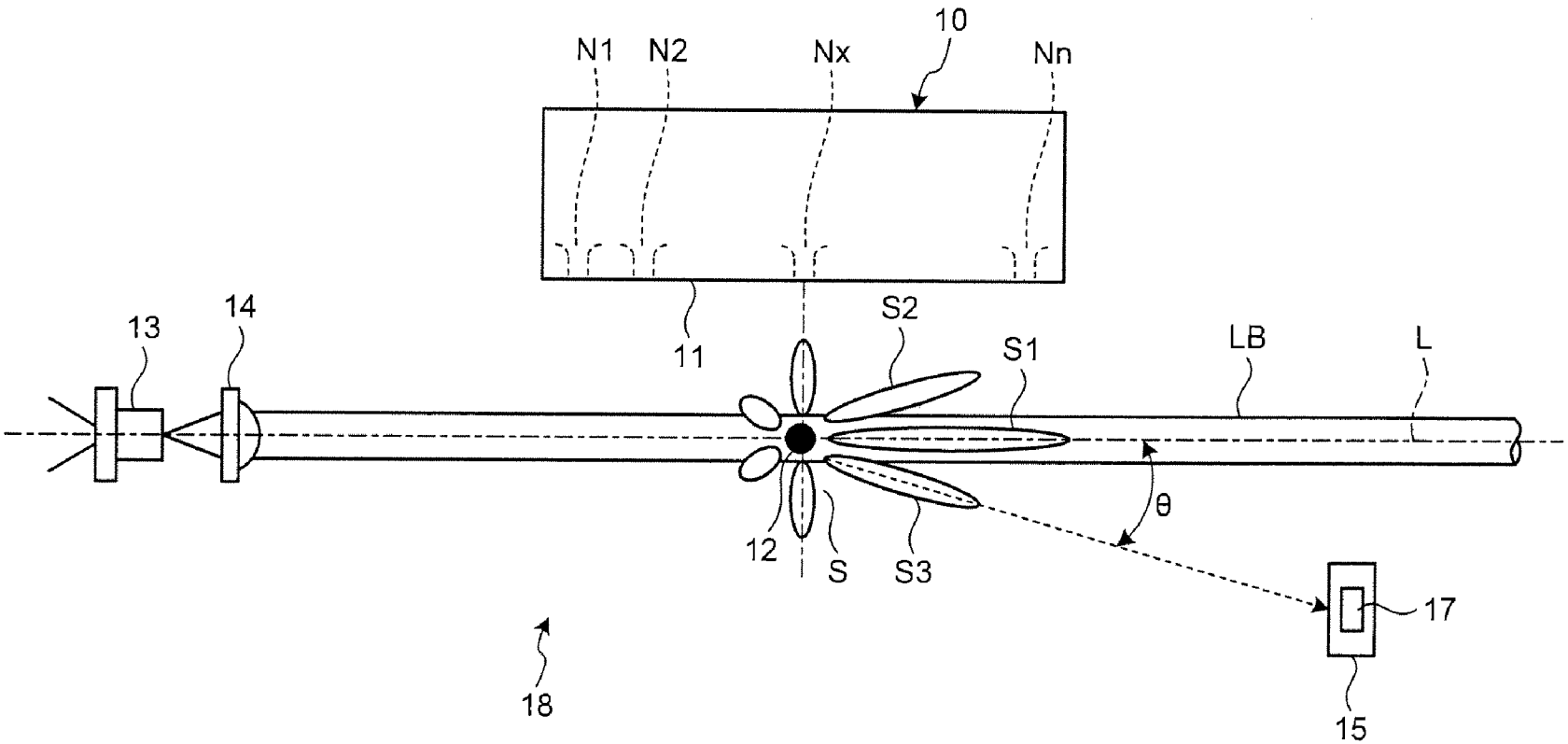
FIG. 1 is a schematic diagram of a liquid-discharge-failure detecting apparatus according to a first embodiment of the present invention along with an inkjet head.

FIG. 1 is a schematic diagram of a liquid-discharge-failure detecting apparatus 18 according to a first embodiment of the present invention. The liquid-discharge-failure detecting apparatus 18 can be incorporated in an inkjet recording apparatus that includes an inkjet head 10. Incidentally, the liquid-discharge-failure detecting apparatus 18 can be incorporated in an apparatus other that an inkjet recording apparatus.

A bottom surface of the inkjet head 10 is a head nozzle surface 11 as a liquid-droplet-discharge surface. On the head nozzle surface 11, a plurality of nozzles N1, N2, . . . , Nx, . . . , and Nn are arranged on a line (hereinafter, "nozzle line"). Ink droplets are discharged from the nozzles N1 to Nn. In the example shown in FIG. 1, an ink droplet 12 is discharged from the nozzle Nx.

The liquid-discharge-failure detecting apparatus 18 detects a liquid discharge failure about the ink droplet 12 discharged from the nozzle Nx. The liquid-discharge-failure detecting apparatus 18 includes a light-emitting element 13, a collimating lens 14, a failure detecting unit (not shown), and a light-receiving element 15. The light-emitting element 13 can be a laser diode (LD) or a light-emitting diode (LED). The light-receiving element 15 can be a photodiode. The light-emitting element 13 emits light, and the light is collimated when it passes through the collimating lens 14. The collimated light, which less easily diffuses, is referred to as a laser beam LB.

The light-emitting element 13 emits the laser beam LB in a direction that intersects with a direction in which the ink droplet 12 is discharged from the head nozzle surface 11 (hereinafter, "discharge direction"). An optical axis L of the laser beam LB emitted from the light-emitting element 13 is substantially parallel to the nozzle line and spaced at a predetermined distance from the head nozzle surface 11.

The laser beam LB has an elliptic cross section. The light-receiving element 15 is located at a position where a receiving surface 17 of the light-receiving element 15 is outside of a beam diameter of the laser beam LB. In the example shown in FIG. 1, the light-receiving element 15 is located below the optical axis L. A straight line that joins the light-receiving element 15 and a point, at which the light beam LB strikes the ink droplet 12, makes an angle θ with the optical axis L.

When the ink droplet 12 is discharged through the nozzle Nx and the detection beam LB strikes this ink droplet 12, a scattered light S is produced due to collision of the detection beam LB with the ink droplet 12. The light-receiving element 15 receives the scattered light S at the receiving surface 17 of the light-receiving element 15. More particularly, the receiving surface 17 receives a forward scattered light S3 out of the scattered light S including lights S1, S2, and S3. The liquid-discharge-failure detecting apparatus 18 obtains data pertaining to the scattered light S by measuring an optical output of the light-receiving element 15, and optically detects various liquid discharge failures such as a misdischarge and an oblique discharge based on the data.

In the first embodiment, an LD is employed as the light-emitting element 13. An LD emits light such that the light diverges both in the perpendicular direction and the parallel direction. Perpendicular/parallel divergence angles of a typical LD are approximately 14 degrees/30 degrees. When the light emitted from the LD is collimated when it passes through the collimating lens 14, the collimated laser beam has an elliptical cross section as shown in FIG. 2.

Figure 2:
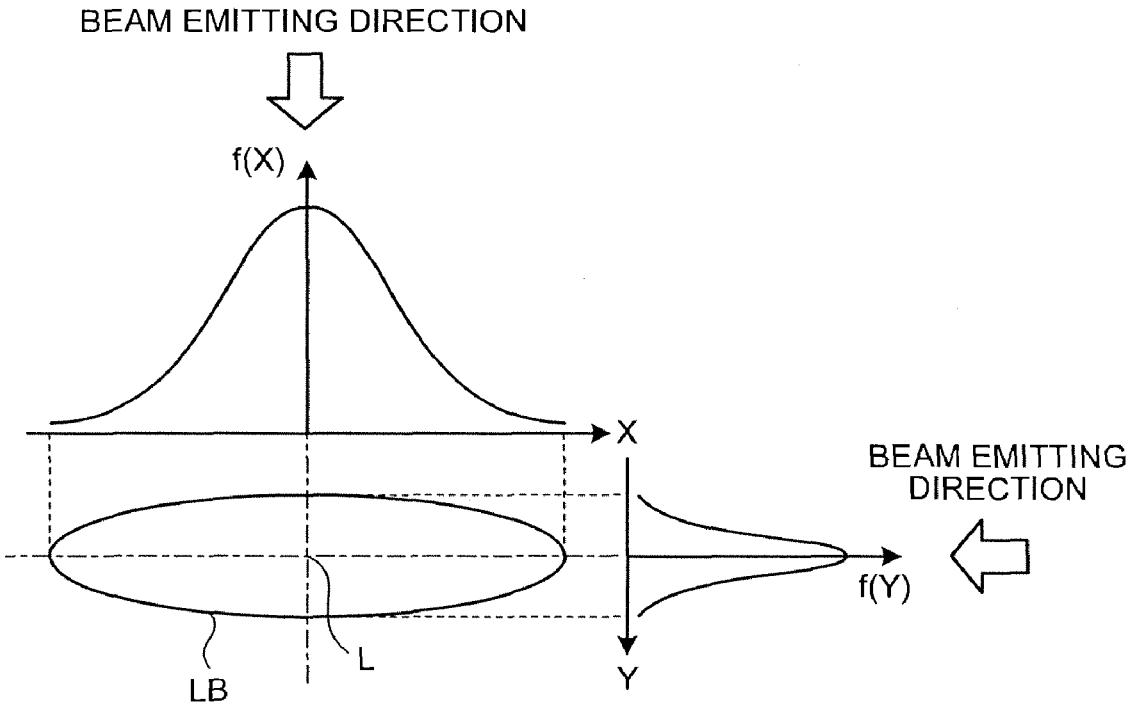
FIG. 2 depicts optical intensity distribution of a light beam utilized by the liquid-discharge-failure detecting apparatus shown in FIG. 1.

FIG. 2 depicts optical intensity distribution of the laser beam LB. X indicates a direction parallel to the major axis of the cross section of the laser beam LB and Y indicates a direction parallel to the minor axis of the cross section. As shown in FIG. 2, the laser beam LB has a Gaussian intensity distribution. More specifically, the optical intensity of the laser beam LB has a peak at the center of the laser beam LB (i.e., on the optical axis L) and gradually decreases toward the circumference.

Figure 3:
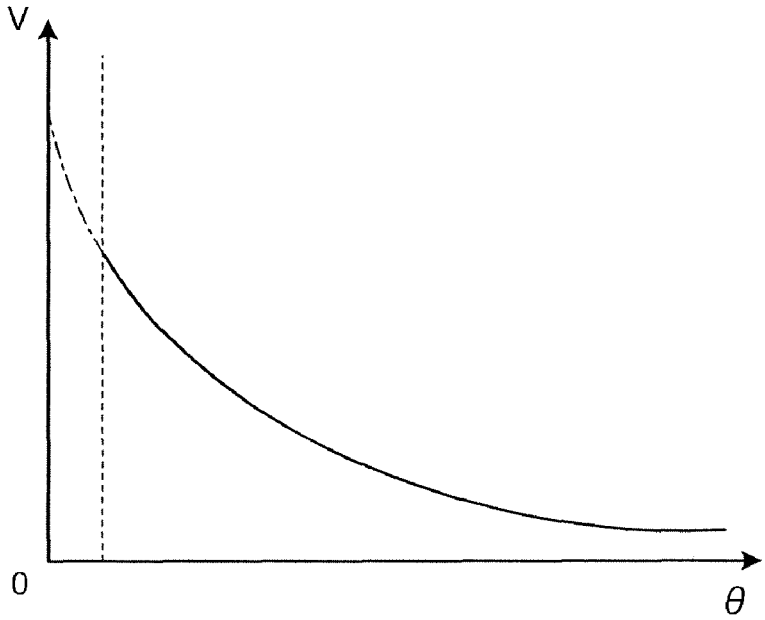
FIG. 3 depicts a relation between an angle θ of a light-receiving element relative to an optical axis of the light beam and an optical output of the light beam received by the light-receiving element of the liquid-discharge-failure detecting apparatus shown in FIG. 1.

FIG. 3 depicts a relation between the angle θ and optical output V of the light-receiving element 15. As shown in FIG. 3, the optical intensity of the scattered light S depends on the angle θ. Specifically, the optical intensity V decreases as the angle θ increases. In other words, the optical output of the light-receiving element 15 depends on the position of the light-receiving element 15.

When the angle θ is so small that the light-receiving element 15 is in the path of the laser beam LB, the laser beam LB directly impinges on the receiving surface 17 of the light-receiving element 15. In this situation, as indicated by a long-dashed and short-dashed line in FIG. 3, a voltage obtained as the optical output of the light-receiving element 15 is substantially saturated when the ink droplet 12 is not discharged. To this end, in the first embodiment, the light-receiving element 15 is positioned outside the beam diameter range.

Figure 4:
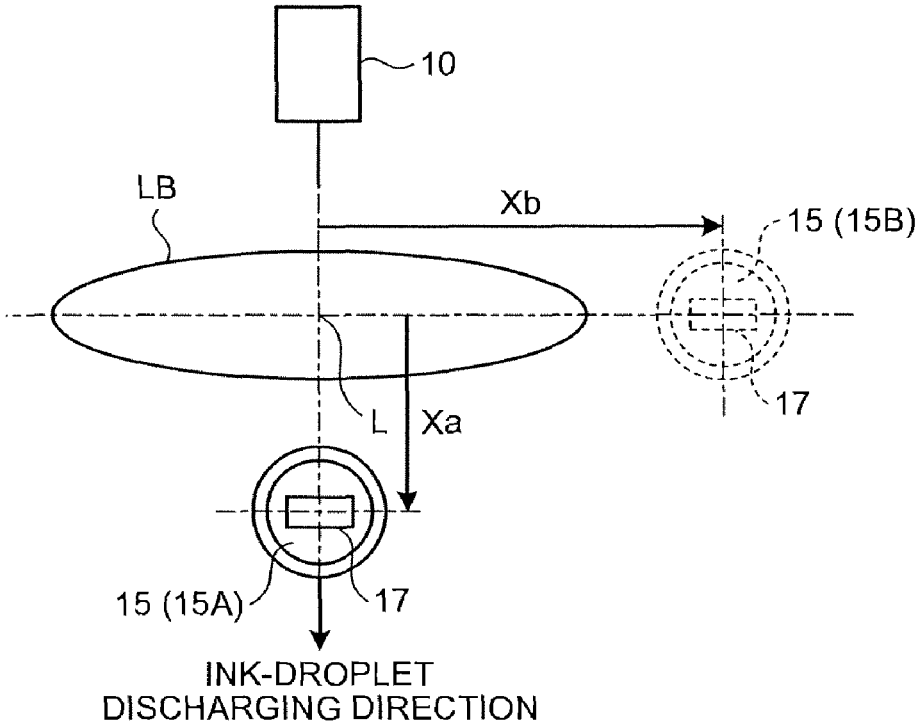
FIG. 4 is a schematic diagram of a positional relationship among the inkjet head, the light beam, and the light-receiving element as viewed along a beam emitting direction of the liquid-discharge-failure detecting apparatus shown in FIG. 1.

FIG. 4 is a schematic diagram depicting a positional relationship among the inkjet head 10, the laser beam LB, and the light-receiving element 15 as viewed along a direction in which the laser beam LB is emitted (hereinafter, "beam emitting direction") in the liquid-discharge-failure detecting apparatus 18.

The light-emitting element 13 emits the light beam LB in such a manner that the X direction shown in FIG. 2 is perpendicular to the discharge direction, and the Y direction is parallel to the discharge direction. As indicated by a solid line in FIG. 4, the light-receiving element 15 is externally adjacent to a circumference of the laser beam LB at a position where a beam diameter of the laser beam LB is small. The light-receiving element 15 is positioned as close to the optical axis L as possible with the receiving surface 17 not overlapping with the laser beam LB.

Figure 5:
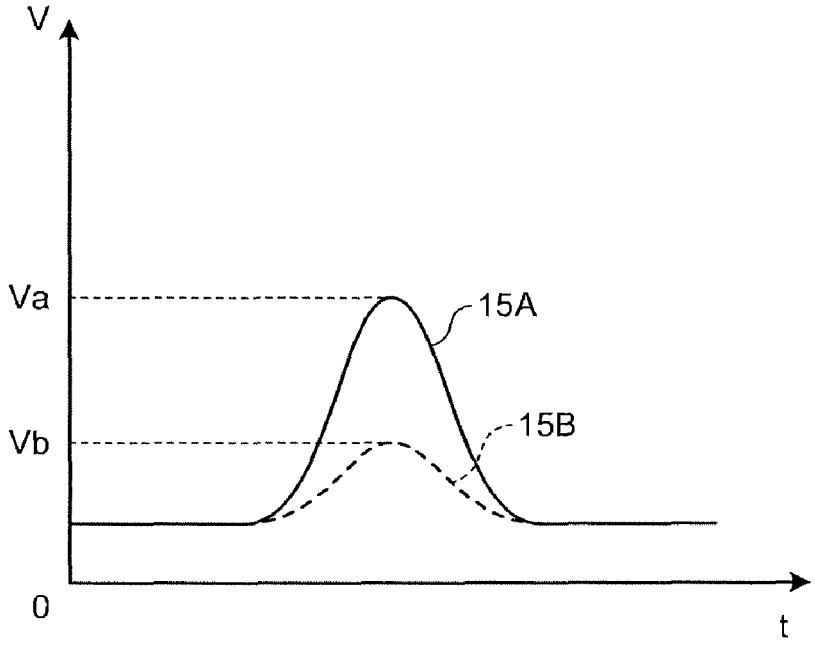
FIG. 5 depicts optical output characteristics of the light-receiving element when an ink droplet discharged from the inkjet head strikes a light beam emitted by an light-emitting element shown in FIG. 1.

FIG. 5 depicts optical output characteristics of the light-receiving element 15 when the ink droplet 12 discharged from the inkjet head 10 strikes the laser beam LB emitted by the light-emitting element 13.

Now assume that, as shown FIG. 4, a light-receiving element 15A is provided externally adjacent to a circumference of the laser beam LB at a position where the beam diameter is small; and a light-receiving element 15B is provided externally adjacent to the circumference at a position where the beam diameter is large. Optical output of the light-receiving element 15A is indicated by a solid line in FIG. 5. Optical output of the light-receiving element 15B is indicated by a dotted line.

The light-receiving elements 15A and 15B are positioned at a distance Xa and a distance Xb, respectively, from the optical axis L. The distances Xa and Xb are determined such that the optical output values of the light-receiving elements 15A and 15B when no ink droplet is discharged from the ink head 10 are equal to each other.

Because the distance Xa between the light-receiving element 15A and the optical axis L is smaller than the distance Xb between the light-receiving element 15B and the optical axis L, an optical output Va of the light-receiving element 15A is greater than an optical output Vb of the light-receiving element 15B (Va>Vb).

When the light-receiving element 15A is located adjacent to the circumference of the laser beam LB at the position where the beam diameter is small, the light-receiving element 15A can receive a high-intensity portion of the scattered light S. This leads to an increase in optical output. More specifically, when the distance of the light-receiving element 15A from the optical axis L is small, the angle θ is small; accordingly, large optical output values can be obtained because of the angular dependence of the scattered light S shown in FIG. 3.

It is also possible to increase the optical output by relocating the light-receiving element 15B toward the optical axis L. However, relocating the light-receiving element 15B toward the optical axis L can cause the laser beam LB to directly impinge on the receiving surface 17 of the light-receiving element 15B as described above. Accordingly, a voltage output of the light-receiving element 15 is substantially saturated when the ink droplet 12 is not discharged, which makes measurement of the scattered light S useless.

Figure 6:
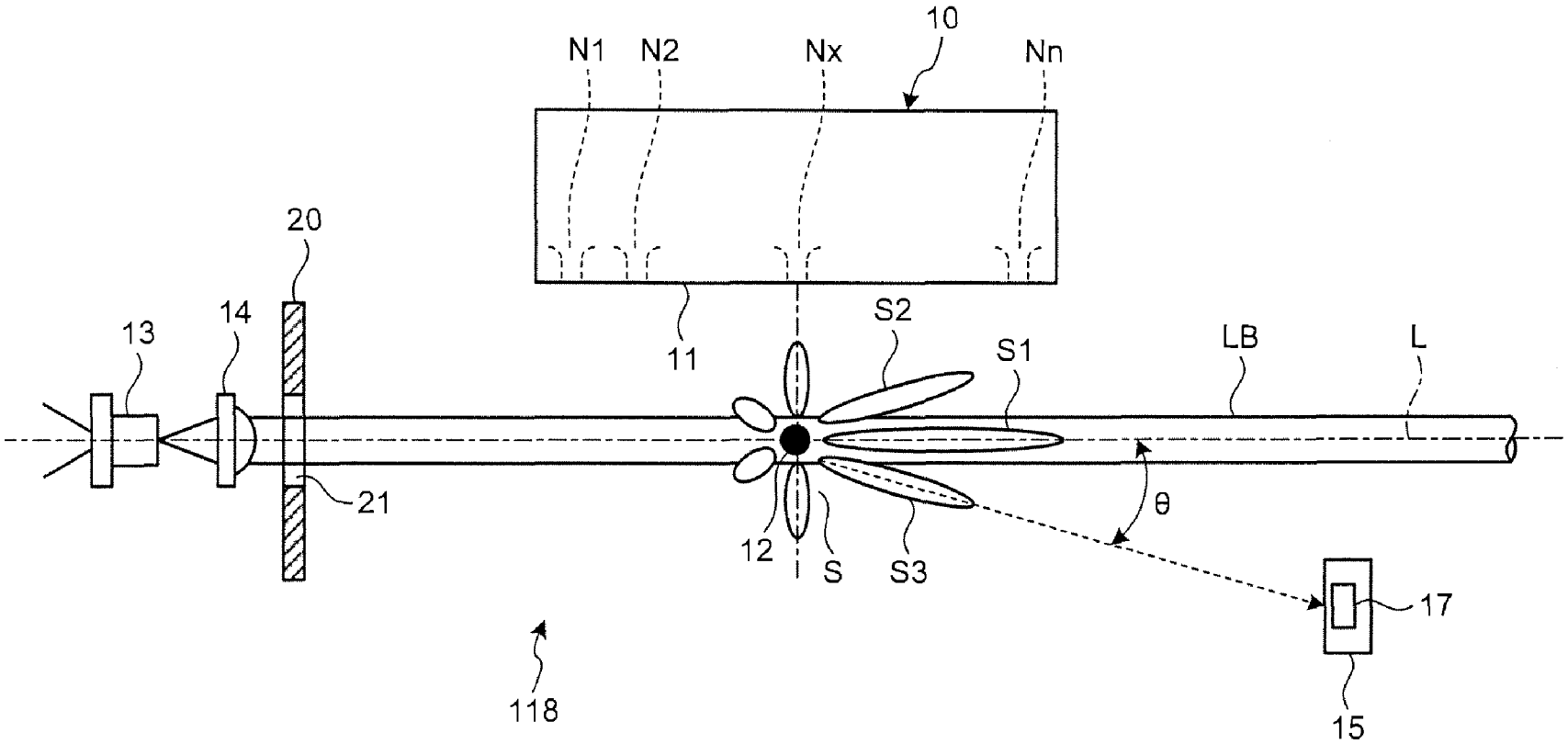
FIG. 6 is a schematic diagram of a liquid-discharge-failure detecting apparatus according to a second embodiment of the present invention with the inkjet head also depicted.

FIG. 6 is a schematic diagram of a liquid-discharge-failure detecting apparatus 118 according to a second embodiment of the present invention. The liquid-discharge-failure detecting apparatus 118 can be incorporated in an inkjet recording apparatus that includes the inkjet head 10. Incidentally, the liquid-discharge-failure detecting apparatus 118 can be incorporated in an apparatus other that an inkjet recording apparatus.

The liquid-discharge-failure detecting apparatus 118 differs from the liquid-discharge-failure detecting apparatus 18 shown in FIG. 1 in that an aperture member 20 is additionally provided between the collimating lens 14 and a position where the laser beam LB strikes the ink droplet 12. Components corresponding to those shown in FIG. 1 are denoted by identical reference numerals. The aperture member 20 has an opening 21 to allow the laser beam LB emitted by the light-emitting element 13 to pass through.

Figure 7:
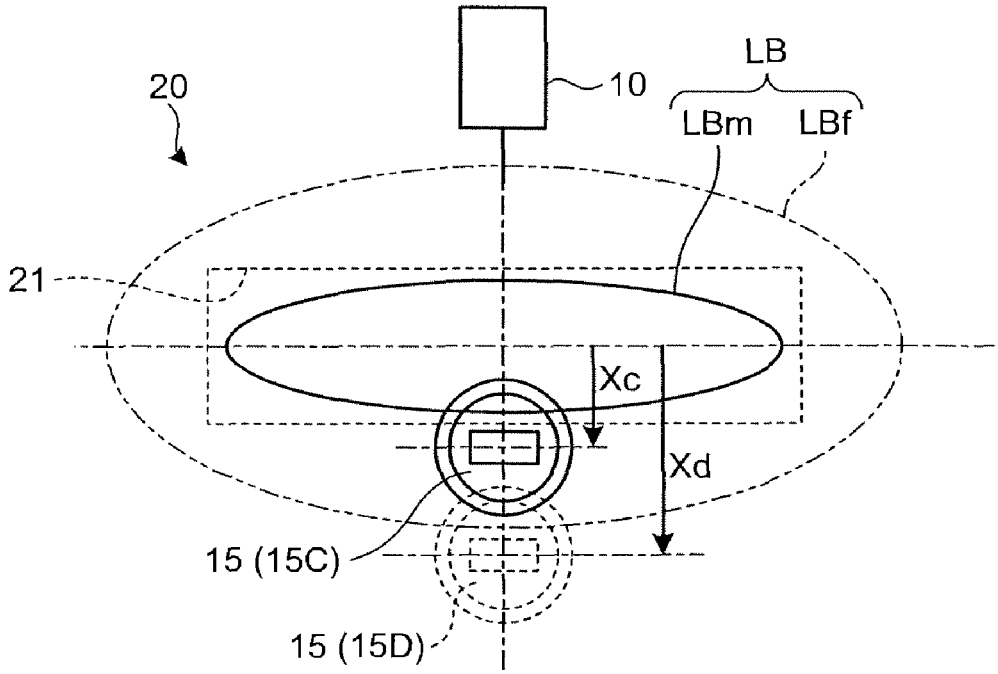
FIG. 7 is a schematic diagram of a positional relationship among the inkjet head, a light beam, a light-receiving element, and an aperture member as viewed along the light beam emitting direction of the liquid-discharge-failure detecting apparatus shown in FIG. 6.

The laser beam LB emitted by the light-emitting element 13 includes, as shown in FIG. 7, a main beam portion LBm and a flare LBf. Optical intensity of the flare LBf is smaller than that of the main beam portion LBm. However, although the optical intensity of the flare LBf is smaller, if it impinges on the light-receiving element 15, the optical output of the light-receiving element 15 can become substantially saturated when the ink droplet 12 is not being discharged. Accordingly, the light-receiving element 15 can be located only up to an outer circumference of the flare LBf toward the optical axis L. This limits an increase in the optical output value of the light-receiving element 15 with the ink droplet 12 being discharged.

The flare LBf is blocked by the aperture member 20 when the laser beam LB passes through the opening 21.

FIG. 7 is a schematic diagram of a positional relationship among the inkjet head 10, the laser beam LB, the light-receiving element 15, and the aperture member 20 as viewed along the beam emitting direction of the liquid-discharge-failure detecting apparatus 118.

In absence of the aperture member 20, due to the flare LBf, the light-receiving element 15 (15D) can be positioned only as close to the optical axis L as at a distance Xd from the optical axis L in FIG. 7. In contrast, when the aperture member 20 is provided, because the flare LBf is blocked by the aperture member 20, the light-receiving element 15 (15C) can be positioned closer to the optical axis L at a distance Xc from the optical axis L.

Figure 8:
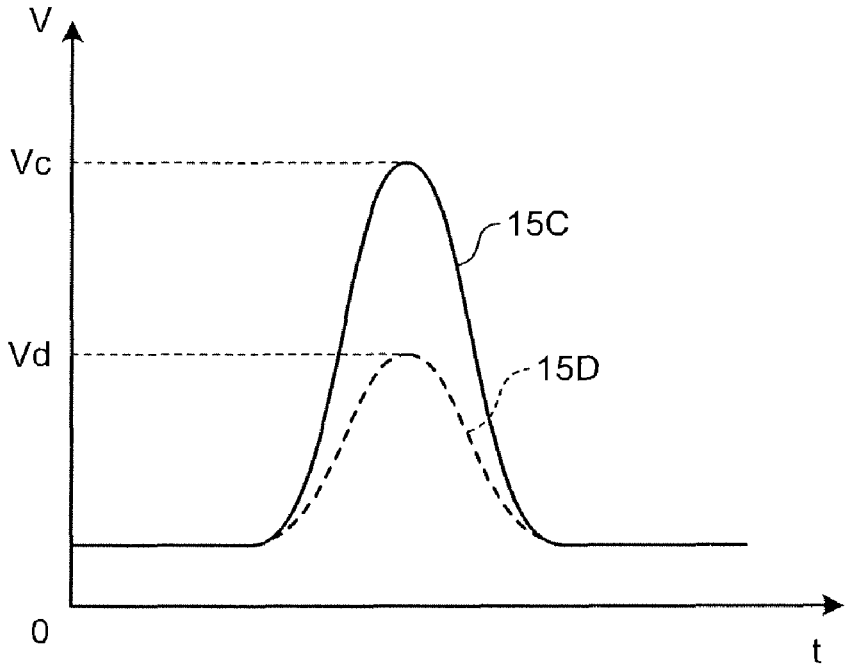
FIG. 8 depicts optical output characteristics of the light-receiving element when an ink droplet discharged from the inkjet head strikes the light beam emitted by a light-emitting element shown in FIG. 6.

FIG. 8 depicts optical output characteristics of the light-receiving element 15 when the ink droplet 12 discharged from the inkjet head 10 strikes the laser beam LB emitted by the light-emitting element 13 in the liquid-discharge-failure detecting apparatus 118.

Because a light-receiving element 15C indicated by solid lines in FIG. 7 can be positioned closer to the optical axis L than a light-receiving element 15D indicated by dotted lines, an optical output value Vc of the light-receiving element 15C is greater than an optical output value Vd of the light-receiving element 15D (Vc>Vd). Hence, by providing the aperture member 20, the optical output values can be increased as shown in FIG. 8.

Figure 9:
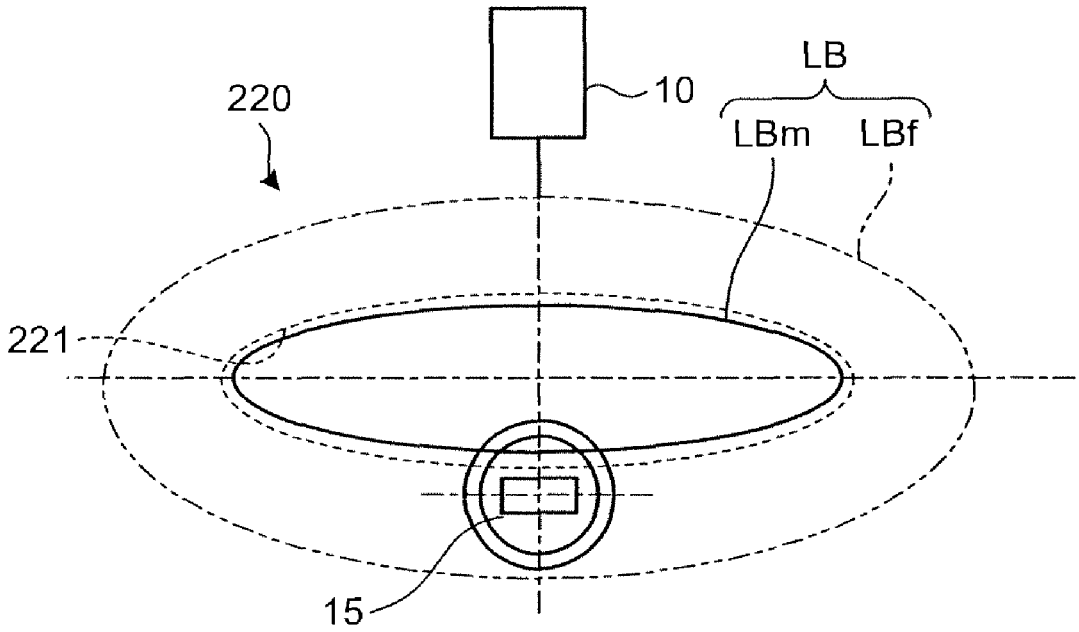
FIG. 9 is a schematic diagram for explaining a variation of the configuration of the aperture member.

FIG. 9 depicts an aperture member 220 that can be used in place of the aperture member 20. The aperture member 220 has an opening 221. The opening 221 has a shape that is substantially identical to the cross-sectional shape of the laser beam LB.

The entire flare LBf of the laser beam LB can be blocked with the aperture member 220. Accordingly, the light-receiving element 15 can be positioned further closer to the optical axis L, and the light-receiving element 15 can effectively receive the scattered light S which is optically intense. Hence, discharge failures of the ink droplet 12 can be detected more accurately.

Figure 10:
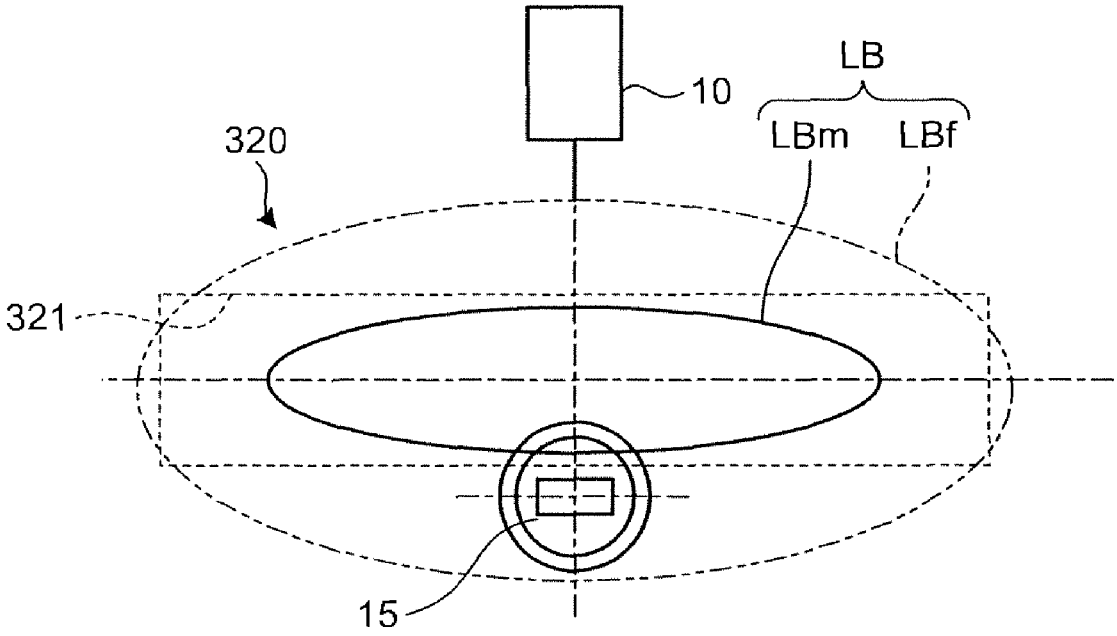
FIG. 10 is a schematic diagram for explaining another variation of the configuration of the aperture member.

FIG. 10 depicts an aperture member 320 that can be used in place of the aperture members 20 or 220. The aperture member 320 has an opening 321. The aperture member 320 blocks only a portion of the laser beam LB around the circumference of the laser beam LB at which the beam diameter is small.

When the aperture member 320 is employed, manufacturing and assembly are facilitated because it is required to ensure accuracy only at the portion around the circumference at which the beam diameter is small. Accordingly, discharge failures of the ink droplet 12 can be detected more accurately with a relatively small additional cost.

Figure 11:
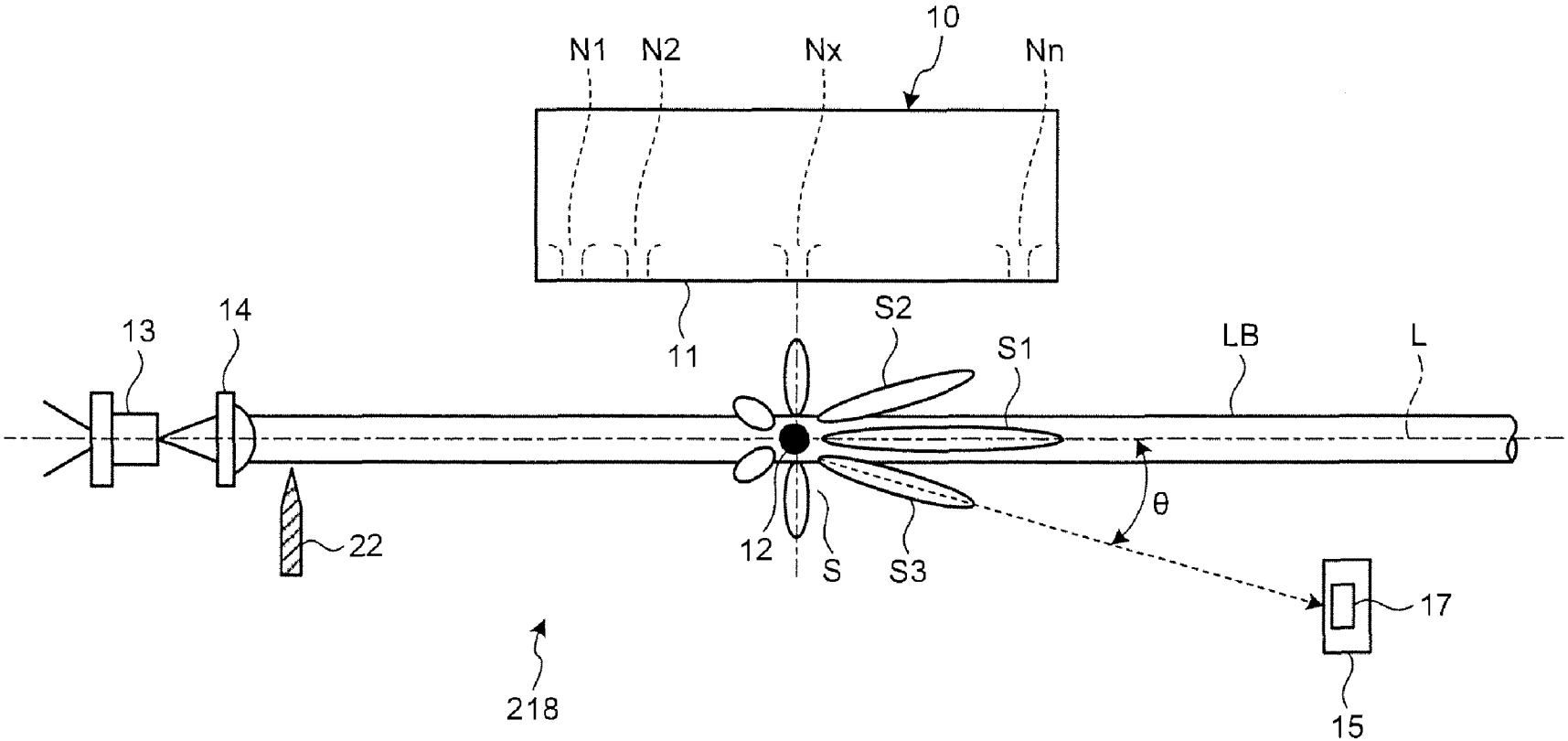
FIG. 11 is a schematic diagram of a liquid-discharge-failure detecting apparatus according to a third embodiment of the present invention with the inkjet head also depicted.

FIG. 11 is a schematic diagram of a liquid-discharge-failure detecting apparatus 218 according to a third embodiment of the present invention. The liquid-discharge-failure detecting apparatus 218 can be incorporated in an inkjet recording apparatus that includes the inkjet head 10. Incidentally, the liquid-discharge-failure detecting apparatus 218 can be incorporated in an apparatus other that an inkjet recording apparatus.

The liquid-discharge-failure detecting apparatus 218 differs from the liquid-discharge-failure detecting apparatus 18 shown in FIG. 1 in that a knife edge 22 is provided between the collimating lens 14 and a position where the laser beam LB strikes the ink droplet 12. Components corresponding to those shown in FIG. 1 are denoted by identical reference numerals. The knife edge 22 blocks only a portion of the flare LBf around the circumference of the laser beam LB near the light-receiving element 15.

Figure 12:
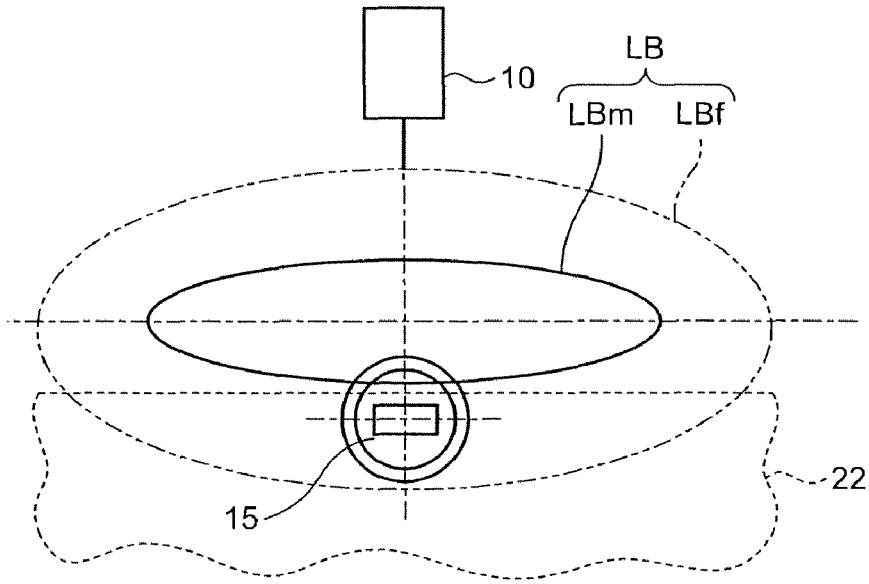
FIG. 12 is a schematic diagram of a positional relationship among the inkjet head, a light beam, a light-receiving element, and a knife edge as viewed along the beam emitting direction of the liquid-discharge-failure detecting apparatus shown in FIG. 11.

FIG. 12 is a schematic diagram of a positional relationship among the inkjet head 10, the laser beam LB, the light-receiving element 15, and the knife edge 22 as viewed along the beam emitting direction of the liquid-discharge-failure detecting apparatus 218.

The aperture member 20, 220, or 320 blocks the flare LBf in the second embodiment. In contrast, in the third embodiment, the knife edge 22 blocks the portion of the flare LBf. The knife edge 22 can be embodied with a member that is simpler than the aperture member 20, 220, or 320. Because it is required to ensure accuracy only at the portion near the light-receiving element 15, manufacturing and assembly are facilitated. Accordingly, discharge failures of the ink droplet 12 can be detected more accurately with a relatively small additional cost.

Although the laser beam LB is a collimated beam in the above description, the laser beam LB can be a focal beam having a focal point near the light-receiving element 15. This configuration for causing the laser beam LB to have the focal point can be attained by adjusting a distance between the collimating lens 14 and the light-emitting element 13 while employing generally the same structure as that employed in the liquid-discharge-failure detecting apparatus 18 shown in FIG. 1.

Figure 13:
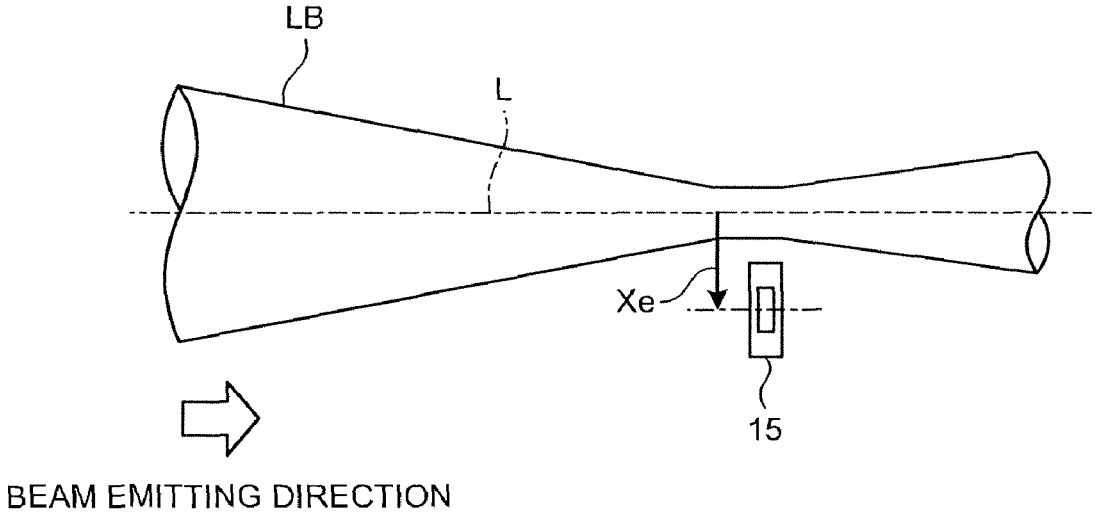
FIG. 13 is a schematic diagram of a light beam having a focal point near the light-receiving element.

FIG. 13 is a schematic diagram of the laser beam LB having the focal point near the light-receiving element 15.

Meanwhile, a diameter of a laser beam is small at its focal point. Accordingly, by causing the laser beam LB to have the focal point near the light-receiving element 15, the light-receiving element 15 can be located closer to the optical axis L, which decreases a distance between the optical axis L and the light-receiving element 15. Hence, the light-receiving element 15 is capable of receiving an optically intense scattered light, which leads to an increase in optical output. Accordingly, discharge failures of the ink droplet 12 can be detected more accurately with a relatively small additional cost and a simple structure.

The same advantage as that obtained from the configuration is obtained by using a laser beam LB1 having a smaller beam diameter than that of the laser beam LB. The laser beam LB1 can be provided by using a light-emitting element having smaller divergence angles (e.g., 7 degrees/14 degrees) as the light-emitting element 13. Alternatively, a lens having a small back focal distance and a small numerical aperture (NA) can be used.

In the third embodiment, the laser beam LB has the focal point by adjusting the distance between the light-emitting element 13 and the collimating lens 14. Alternatively, the focal point can be provided by replacing the collimating lens 14 with another lens which differs from the collimating lens 14 in property. For example, a convex lens, through which light is focused, can be employed.

In the above embodiments, the light-emitting element 13 emits the laser beam LB such that the X direction, in which the beam diameter of the laser beam LB is large, is perpendicular to the discharge direction. This arrangement is advantageous in widening a detectable range in the direction perpendicular to the beam emitting direction. This arrangement further provides the following advantages: required accuracy in mounting the liquid-discharge-failure detecting apparatus 18 onto the inkjet recording apparatus and positional accuracy between the nozzle line and the laser beam LB can be relaxed; and discharge failures of the ink droplet 12 can be detected more accurately with a relatively small additional cost and a simple structure. However, optical intensity of the laser beam LB changes more moderately in the X direction than in the Y direction. Accordingly, the optical intensity distribution of the laser beam LB in the X direction is less appropriate for detection of an oblique discharge at a sharp angle.

Because the laser beam LB has a Gaussian intensity distribution, optical output of an improperly-discharged ink droplet 12B that does not travel through the optical axis L is smaller than optical output of a properly-discharged ink droplet 12A that travels through the optical axis L. Therefore, oblique discharge of the ink droplet 12B can be detected based on a difference between the optical output of the ink droplet 12A and the optical output of the ink droplet 12B. When an oblique discharge occurs, the optical output value decreases larger in the region where the Gaussian distribution is steeper than in the region where the Gaussian distribution is larger. Accordingly, an oblique discharge can be detected more easily in the region where the Gaussian distribution is steeper.

Figure 14:
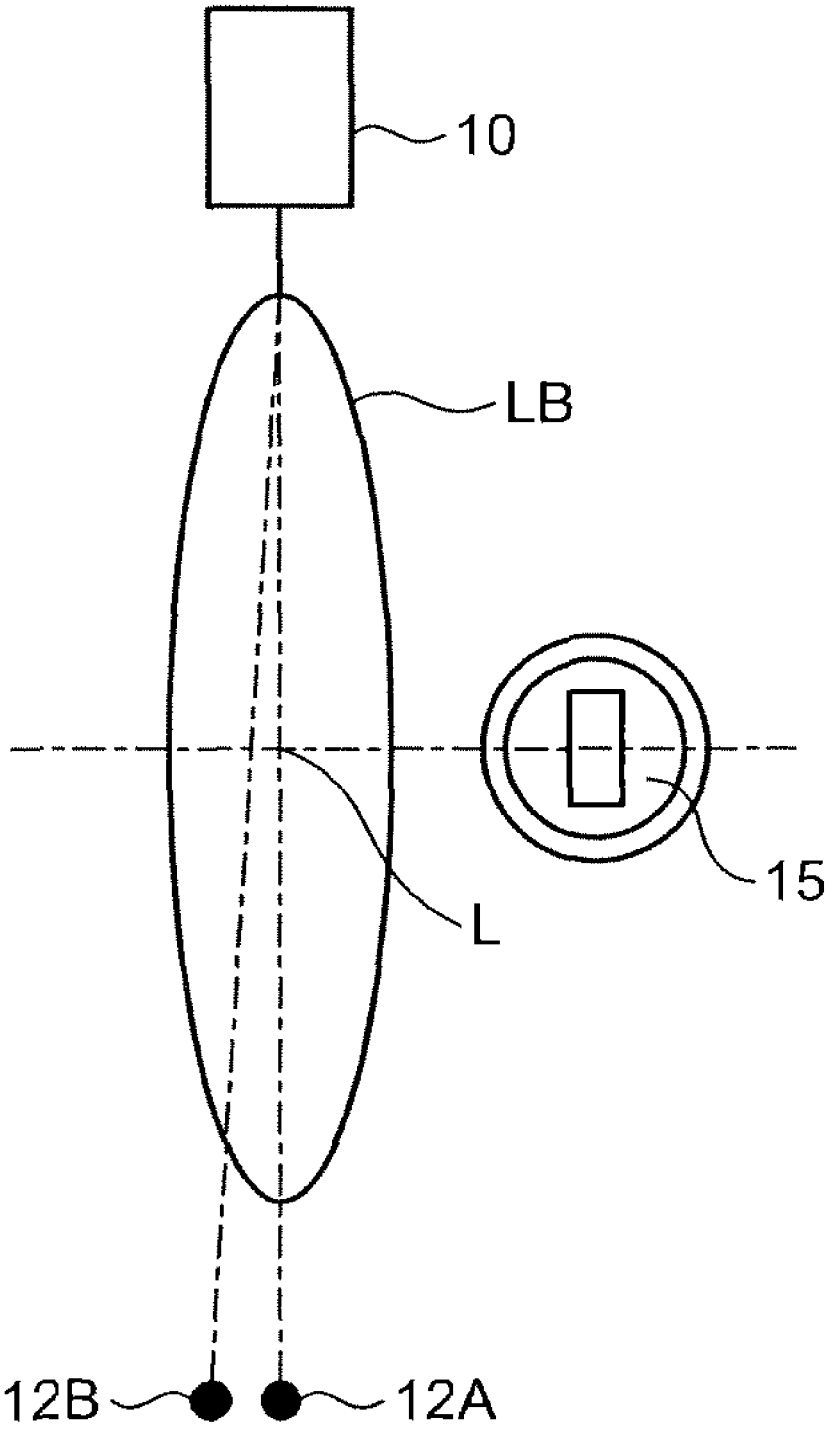
FIG. 14 is a schematic diagram for explaining a modification, in which a major axis of the cross section of a light beam is substantially parallel to a discharge direction of an ink droplet.

Hence, by orienting the laser beam LB such that the Y direction is perpendicular to the discharge direction as shown in FIG. 14, oblique discharge at a sharp angle can be detected easily. In this case, because an optical output value of the light-receiving element 15 is generally highest when the light-receiving element 15 is positioned near the optical axis L, the light-receiving element 15 is preferably positioned adjacent to the circumference of the laser beam LB as shown in FIG. 14.

As a stand-alone recovery unit that recovers a detected failure, a known stand-alone recovery unit can be employed. Such a stand-alone recovery unit performs cleaning of the nozzles, forced discharging, partial suction, and the like. By causing such a stand-alone recovery unit to perform recovery of a liquid discharge failure detected by the liquid-discharge-failure detecting apparatus 18, waste of ink and time can be prevented.

According to an aspect of the present invention, a light-receiving element is positioned close to an optical axis of a laser beam so that the light-receiving element can receive an intense scattered light. Because a voltage value obtained as an optical output of the light-receiving element is not saturated when no ink droplet is discharged, liquid discharge failures can be detected based on data pertaining to receiving of a scattered light. Hence, liquid discharge failures can be detected accurately with a relatively small additional cost and a simple structure.

Moreover, because a detectable range in a direction perpendicular to a beam emitting direction can be widened, required accuracy in mounting of the liquid-discharge-failure detecting apparatus and positional accuracy between a nozzle line and the laser beam can be relaxed. Furthermore, liquid discharge failures can be detected more accurately with an easily-implementable structure and without requiring an excessive additional cost.

Moreover, because it is required to ensure accuracy only in the X direction, manufacturing and assembly are facilitated. Accordingly, discharge failures of a droplet can be detected more accurately with a relatively small additional cost.

Furthermore, a detected liquid discharge failure can be recovered efficiently with a small liquid consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid-discharge-failure detecting apparatus that detects a liquid discharge failure of a droplet of discharged liquid, the liquid-discharge-failure detecting apparatus comprising:

a light-emitting element that emits a light beam having an optical axis and having an elliptical cross section, wherein the light-emitting element is arranged to emit the light beam in a direction of the optical axis that intersects a discharge direction in which the droplet is discharged, so that the light beam is emitted onto the droplet;

a light-receiving element that is arranged to be externally adjacent to a circumference of the light beam in a direction parallel to a minor axis of the elliptical cross section and to be located close to the optical axis, to receive a scattered light generated by scattering of the light beam by the droplet when the light beam strikes the droplet; and a failure detecting unit that detects the liquid discharge failure by using data pertaining to the scattered light received by the light-receiving element.

2. The liquid-discharge-failure detecting apparatus according to claim 1, wherein the light-emitting element emits the light beam so that a major axis of the cross section of the light beam is substantially perpendicular to the discharge direction.

3. The liquid-discharge-failure detecting apparatus according to claim 1, wherein the light-emitting element emits the light beam so that a major axis of the cross section of the light beam is substantially parallel to the discharge direction.

4. The liquid-discharge-failure detecting apparatus according to claim 1, further comprising an aperture member arranged between the light-emitting element and the light-receiving element, the aperture member having an opening for shaping the light beam before the light beam strikes the droplet.

5. The liquid-discharge-failure detecting apparatus according to claim 4, wherein the opening substantially coincides in shape with the cross section of the light beam.

6. The liquid-discharge-failure detecting apparatus according to claim 4, wherein the aperture member blocks a portion of a flare of the light beam around the circumference where a diameter of the light beam is small.

7. The liquid-discharge-failure detecting apparatus according to claim 1, further comprising a knife edge arranged between the light-emitting element and the light-receiving element, the knife edge blocking a portion of a flare of the light beam around the circumference.

8. The liquid-discharge-failure detecting apparatus according to claim 1, wherein the beam has a focal point near the light-receiving element.

9. An inkjet recording apparatus comprising:

a liquid-discharge-failure detecting apparatus that detects a liquid discharge failure of a droplet of discharged liquid, the liquid-discharge-failure detecting apparatus comprising:

a light-emitting element that emits a light beam having an optical axis and having an elliptical cross section, wherein the light-emitting element is arranged to emit the light beam in a direction of the optical axis that intersects a discharge direction in which the droplet is discharged, so that the light beam is emitted onto the droplet;

a light-receiving element that is arranged to be externally adjacent to a circumference of the light beam in a direction parallel to a minor axis of the elliptical cross section and to be located close to the optical axis, to receive a scattered light generated by scattering of the light beam by the droplet when the light beam strikes the droplet; and a failure detecting unit that detects the liquid discharge failure by using data pertaining to the scattered light received by the light-receiving element; and a stand-alone recovery unit that recovers a liquid discharge failure detected by the liquid-discharge-failure detecting apparatus.

* * * * *